US007913745B2

(12) United States Patent
Tsukaguchi et al.

(10) Patent No.: US 7,913,745 B2
(45) Date of Patent: Mar. 29, 2011

(54) METHOD OF CONTINUOUS CASTING OF SMALL CROSS SECTION BILLET

(75) Inventors: Yuichi Tsukaguchi, Ibaraki (JP); Masayuki Kawamoto, Ibaraki (JP); Masahito Hanao, Ibaraki (JP); Atsushi Hirata, Wakayama (JP); Hiroshi Hayashi, Wakayama (JP); Manabu Adachi, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/579,449

(22) Filed: Oct. 15, 2009

(65) Prior Publication Data

US 2010/0032129 A1 Feb. 11, 2010

Related U.S. Application Data

(63) Continuation of application No. PCT/JP2007/064552, filed on Jul. 25, 2007.

(30) Foreign Application Priority Data

Jun. 27, 2007 (JP) ..... 2007-168853

(51) Int. Cl.
*B22D 11/00* (2006.01)

(52) U.S. Cl. ..... 164/478; 164/416; 164/418; 164/459; 164/453; 164/151.3; 164/449.1; 164/450.1; 164/454; 164/413; 164/455

(58) Field of Classification Search ..... 164/478, 164/416, 418, 459, 453, 151.1, 449.1, 450.1, 164/454, 413, 455
See application file for complete search history.

(56) References Cited

U.S. PATENT DOCUMENTS

2001/0027854 A1* 10/2001 Kikuchi et al. ..... 164/478

FOREIGN PATENT DOCUMENTS

| | | |
|---|---|---|
| JP | 60-87955 | 5/1985 |
| JP | 61-20653 | 1/1986 |
| JP | 6-15425 | 1/1994 |
| JP | 8-19845 | 1/1996 |
| JP | 8-187562 | 7/1996 |
| JP | 3298586 | 4/2002 |
| JP | 2003-1387 | 1/2003 |

* cited by examiner

*Primary Examiner* — Jessica L Ward
*Assistant Examiner* — Erin B Saad
(74) *Attorney, Agent, or Firm* — Clark & Brody

(57) ABSTRACT

A method for continuously casting a billet with a small cross section in which a curved type or vertical type continuous casting machine is used while oscillating the mold upward and downward is characterized in that the casting machine is provided with a mechanism for withdrawing speed oscillation. The mechanism has structural play in the directions of driving and reverse driving in such a manner that the amount of a play-incurred displacement from the neutral position of the structural play in the direction of billet driving or reverse driving is ±2 to ±30 mm in the direction of driving on the pinch roll circumferential length equivalent basis. The mechanism produces a returning force toward the neutral position and operational parameters such as the billet length, the specific amount of secondary cooling water, the casting speed as well as the oscillation amplitude and frequency are optimized.

1 Claim, 2 Drawing Sheets

METHOD OF CONTINUOUS CASTING OF SMALL CROSS SECTION BILLET

This application is a continuation of International Patent Application No. PCT/JP2007/064552, filed Jul. 25, 2007. This PCT application was not in English as published under PCT Article 21(2).

TECHNICAL FIELD

The present invention relates to a method for continuously casting a billet with a small cross section in which reducing the friction force between the mold and the billet prevents the occurrence of sticking and makes it possible to carry out stable operations in continuous steel casting.

BACKGROUND ART

In the art, various devices with respect to the condition of mold oscillation have been contemplated as technologies for increasing the lubrication in the mold in continuous casting. For example, in Japanese Patent Application Publication S61-20653 and Japanese Patent Application Publication S60-87955, there is disclosed a mold oscillation method utilizing a non-sine oscillation wave in which the upward speed of the mold is lower than the downward speed and, in Japanese Patent Application Publication H06-15425, there is disclosed an oscillation method in which the frequency or oscillation amplitude of the mold is controlled so that an appropriate negative strip time may be maintained for each steel grade. Further, Japanese Patent Application Publication H08-19845 discloses an oscillation technique involving a high-speed wave of oscillation equal to or higher than 40 mm/s during the upward period in mold oscillation, and Japanese Patent Application Publication H08-187562 discloses a method comprising increasing the oscillation amplitude according to the increase in casting speed while maintaining the frequency of mold oscillation within a certain range.

However, the inventions cited above are all directed only to devices concerning the condition of mold oscillation and therefore each naturally has its limits with respect to the effect of reducing the friction force between the mold and the billet.

Concerning this problem, the present inventors proposed, in Japanese Patent No. 3,298,586, a technology substituting for an improvement in lubrication by the above-mentioned oscillation alone. Thus, they proposed a continuous casting machine in which a mechanism having structural play, or an allowance of free motion, incorporated in the driving mechanism for pinch rolls is used to decrease the withdrawing speed during the upward movement of the mold and increase the withdrawing speed during the downward movement of the mold and thereby reduce the friction force between the mold and the billet in the mold. By using the continuous casting machine disclosed in the document cited above, it becomes possible to markedly reduce the friction force in question. For producing that effect stably, however, there is still room for improvement from the technological viewpoint.

DISCLOSURE OF INVENTION

The present invention, which has been made in view of the problems discussed above, has for its object to provide a method for continuously casting a billet with a small cross section in which the effects of the invention described in the above-cited Japanese Patent No. 3,298,586 can be produced more stably based on the findings obtained in the subsequent technological developments regarding the reduction in friction force between mold and billet.

The present inventors pushed ahead with their research and development works to solve the above problems and establish a method for continuously casting a billet with a small cross section according to which the effects of the invention disclosed in the above-cited Japanese Patent No. 3,298,586 can be produced in a more stable manner and, as a result, obtained the following findings (a)-(g). These findings have now led to completion of the present invention.

(a) The mechanism for withdrawing speed oscillation as described in the above-cited Japanese Patent Document No. 6 is suited for application in carrying out the continuous casting method using a curved type continuous casting machine or a vertical type continuous casting machine. This is because when the mechanism is applied to such a casting machine as mentioned above, the friction force in the billet bending zone is low and the movements of the billet in association with the mold oscillation are readily transmitted to pinch rolls downstream in casting.

(b) By using a mechanism for withdrawing speed oscillation, which makes the billet withdrawing speed during the upward period of mold oscillation slower than the average withdrawing speed and that during the downward period of mold oscillation faster than the average withdrawing speed, it becomes possible to reduce the maximum friction force between the mold and the billet. The reason is that the friction force increases during the upward period of mold oscillation during which the relative velocity (difference of velocity) between the mold and the billet increases and it decreases during the downward period of mold oscillation during which the relative velocity decreases and, therefore, by lowering the billet withdrawing speed during the upward period of mold oscillation and increasing the billet withdrawing speed during the downward period of mold oscillation, it becomes possible to reduce the maximum friction force.

(c) Suitable as the mechanism for withdrawing speed oscillation mentioned above under (b) is a mechanism comprising elastic parts either alone or in combination with dampers between the motors for driving pinch rolls at a speed corresponding to an aimed withdrawing speed and the pinch rolls and further having structural play in the directions of driving and reverse driving. This is because such mechanism is simple and can be designed in a compact manner.

(d) Suitable as the mechanism for withdrawing speed oscillation mentioned above under (c) is a mechanism in which the amount of a play-incurred displacement from the neutral position of play in the direction of billet driving or in the direction of reverse driving is 2-30 mm in the direction of driving and 2-30 mm in the direction of reverse driving, each on the pinch roll circumferential length equivalent basis, and which has a function such that the reaction force of the elastic parts for returning to the neutral position increases in response to the increase in play-incurred displacement from the neutral position.

(e) It is necessary that the cross sectional area of the casting target billet be not more than 700 $cm^2$ and that the length of the billet from the meniscus in the mold to the site of cutting of the billet be not more than 50 m. When the cross sectional area or length of the billet exceeds the value given above, the mass of the billet from the mold to the pinch rolls becomes great and the friction force within the mold becomes relatively weak as compared with the inertial force of the billet, with the result that the effects of the invention are hardly produced.

(f) It is necessary that the amount of secondary cooling water for the billet be not more than 0.8 liter (L)/kg of steel and that the casting speed be not less than 1.5 m/min. When the specific amount of secondary cooling water or the casting speed is outside the above range, the average temperature of the billet from the mold to the pinch rolls lowers and the elastic expansion and contraction of the billet become decreased, so that the friction force within the mold cannot be suppressed to a sufficient extent just by providing the mechanism for withdrawing speed oscillation as mentioned above under (a)-(d) alone.

(g) It is necessary that the amplitude of oscillation be ±1.5 to ±4.0 mm. This is for securing the effect of promoting the consumption of a lubricant, such as a mold powder, between the billet surface and the mold and preventing unwanted variations in withdrawing speed. Further, it is necessary that the frequency of oscillation be not more than 450 cpm (cycles/minute). This is for allowing the movement of the billet to follow the oscillation.

The gist of the present invention, which has been completed based on the above findings, consists in the following continuous casting method. Thus, it consists in:

"A method for continuously casting a billet with a small cross section in which the billet has a cross sectional area of not more than 700 $cm^2$ and a curved type or vertical type continuous casting machine is used while oscillating the mold upward and downward, characterized in that: the casting machine is provided with a mechanism for withdrawing speed oscillation wherein the mechanism comprises elastic parts either alone or in combination with dampers between the motors for driving pinch rolls at a speed corresponding to an aimed withdrawing speed and the pinch rolls for withdrawing or supporting the billet, the mechanism has structural play in the directions of driving and reverse driving in such a manner that the amount of a play-incurred displacement from the neutral position of the play in the direction of driving the billet or reverse driving is 2-30 mm in the direction of driving and 2-30 mm in the direction of reverse driving, each on the pinch roll circumferential length equivalent basis, and the mechanism has a function such that the reaction force of the elastic parts for returning to the neutral position increases in response to the increase in the play-incurred displacement from the neutral position, that the drive of each motor is transmitted to the pinch rolls via the mechanism for withdrawing speed oscillation to thereby make the billet withdrawing speed during the upward period of mold oscillation slower than the average withdrawing speed and that during the downward period of mold oscillation faster than the average withdrawing speed; and operational parameters are set such that the length of the billet from the meniscus in the mold to the site of cutting of the billet is not more than 50 m, the specific amount of secondary cooling water is not more than 0.8 liter/kg of steel, the casting speed is not less than 1.5 m/min, the amplitude of oscillation is ±1.5 to ±4.0 mm and the frequency of oscillation is not more than 450 cpm."

The term "aimed withdrawing speed" as used herein means an ordinary billet withdrawing speed determined based on the operational conditions in continuous casting.

The term "elastic part" means a body having properties such that when deformed under the action of an external force, it generates stress on the inside and, when the external force is removed, it returns to its original shape. It includes springs such as coil springs and plate springs and rubbers such as natural rubbers and synthetic rubbers, among others.

The term "neutral position of structural play" means the position where the reaction force exerted by the elastic parts is zero (0) in the directions of driving and reverse driving of each motor within the tolerable range of structural play.

BEST MODES FOR CARRYING OUT THE INVENTION

1. Basic Constitution of the Invention

As mentioned hereinabove, the invention consists in a method for continuously casting a billet with a small cross section in which the billet has a cross sectional area of not more than 700 $cm^2$ and a curved type or vertical type continuous casting machine is used while oscillating the mold upward and downward, characterized in that: the casting machine is provided with a mechanism for withdrawing speed oscillation, wherein the mechanism comprises elastic parts either alone or in combination with dampers between the motors for driving pinch rolls at a speed corresponding to an aimed withdrawing speed and the pinch rolls, the mechanism has structural play in the directions of driving and reverse driving in such a manner that the amount of a play-incurred displacement from the neutral position of the play in the direction of driving the billet or reverse driving is 2-30 mm in the direction of driving and 2-30 mm in the direction of reverse driving, each on the pinch roll circumferential length equivalent basis, and the mechanism further has a function such that the reaction force of the elastic parts for returning to the neutral position increases in response to the increase in the play-incurred displacement from the neutral position; the drive of each motor is transmitted to the pinch rolls via the mechanism for withdrawing speed oscillation, whereby: the billet withdrawing speed during the upward period of mold oscillation becomes slower than the average withdrawing speed and during the downward period of mold oscillation, faster than the average withdrawing speed; and operational parameters are set such that the length of the billet from the meniscus to the site of cutting of the billet is not more than 50 m, the specific amount of secondary cooling water is not more than 0.8 liter/kg of steel, the casting speed is not less than 1.5 m/min, the amplitude of oscillation is ±1.5 to ±4.0 mm, and the frequency of oscillation is not more than 450 cpm. In the following, the subject matter of the invention is described in further detail.

Figure 1:
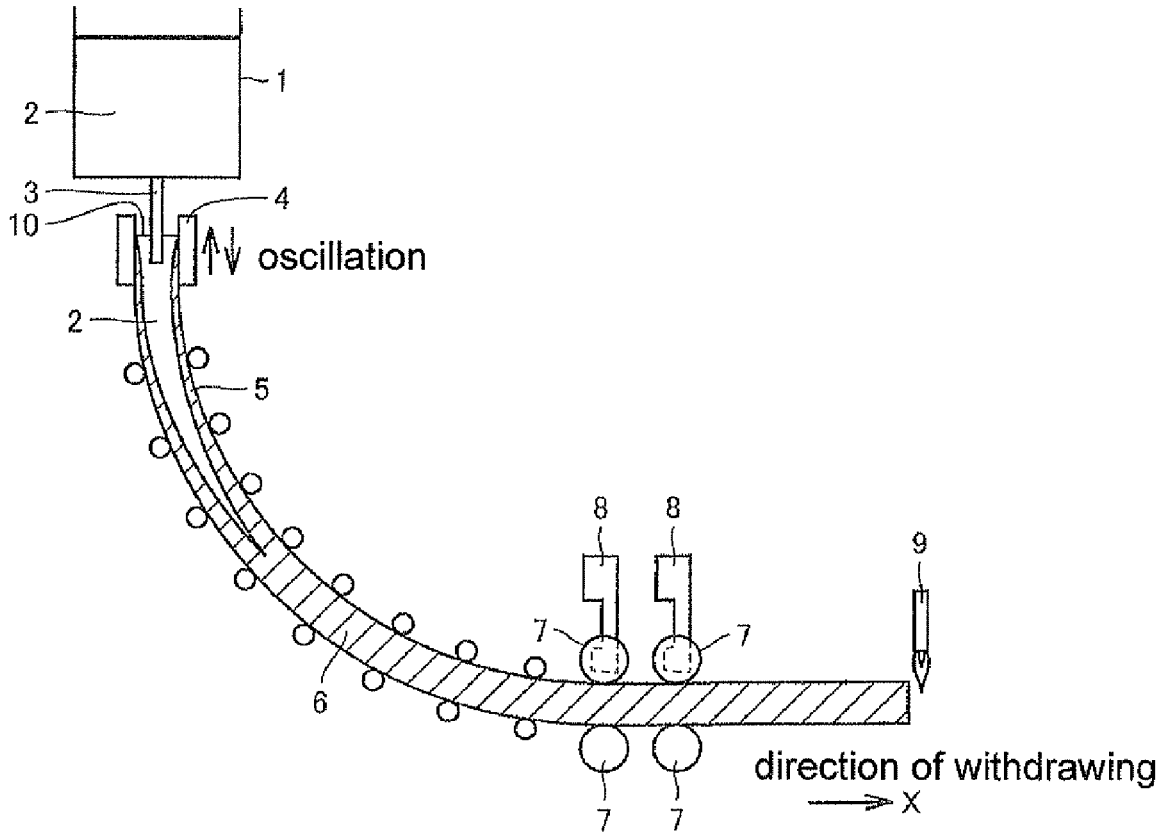
FIG. 1 is a schematic representation of an example of the implementation of the continuous casting method of the invention using a curved type continuous casting machine.

FIG. 1 is a schematic representation of an example of the implementation of the continuous casting method of the invention using a curved type continuous casting machine. The molten steel 2 contained in a tundish 1 is poured, through an immersion nozzle 3, into a mold 4 moving upward and downward in an oscillating manner and cooled with cooling water within the mold and with secondary spray water sprayed from a group of secondary cooling spray nozzles (not shown) to form a solidified shell 5 and then form a billet 6. The billet 6 is withdrawn in the direction indicated by the arrow X in the figure by pinch rolls which are driven to rotate and cut by means of a billet cutting device (cutting torch) 9.

The pinch rolls 7 are rotated by the driving force transmitted from a pinch roll driving mechanism 8 and withdraw the billet 6. The pinch roll driving mechanism 8 comprises motors for driving the pinch rolls 7 at a speed corresponding to an aimed withdrawing speed and elastic parts either alone or in combination with dampers between the motors and the pinch rolls and is equipped with a mechanism for withdrawing speed oscillation having structural play in the directions of driving and reverse driving.

As described hereinabove, this mechanism for withdrawing speed oscillation has structural play in the directions of driving and reverse driving and has a function such that the reaction force of the elastic parts for returning to the neutral position increases in response to the increase in the play-incurred displacement from the neutral position of the play. Therefore, as a result of such action, the withdrawing speed of the billet 6 by the pinch rolls 7 is passively reduced or increased in response to the changes of the friction force in the mold as exerted on the billet 6 where the force increases or decreases according to the ascending or descending of the mold 4 due to mold oscillation.

Figure 2:
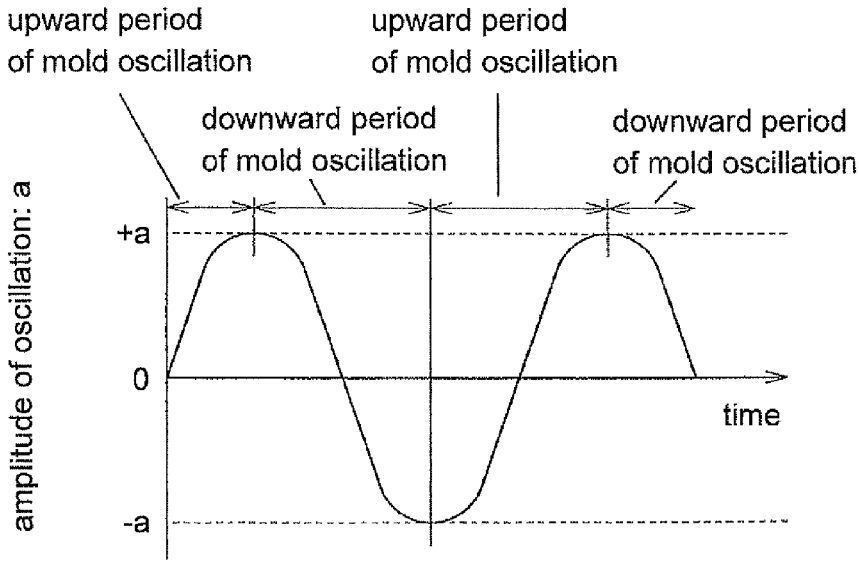
FIG. 2 is a depiction showing an example of mold oscillation.

FIG. 2 shows an example of the mold oscillation. During the period of ascending of the mold 4, the mold is moved upward, then passes across the neutral position (reference position) and further ascends to the upper highest position (+a). During the period of descending of the mold 4, the mold is moved downward, passes across the neutral point and further descends to the lowest position (−a). In this manner, the mold 4 performs a periodic oscillation movement.

Figure 3:
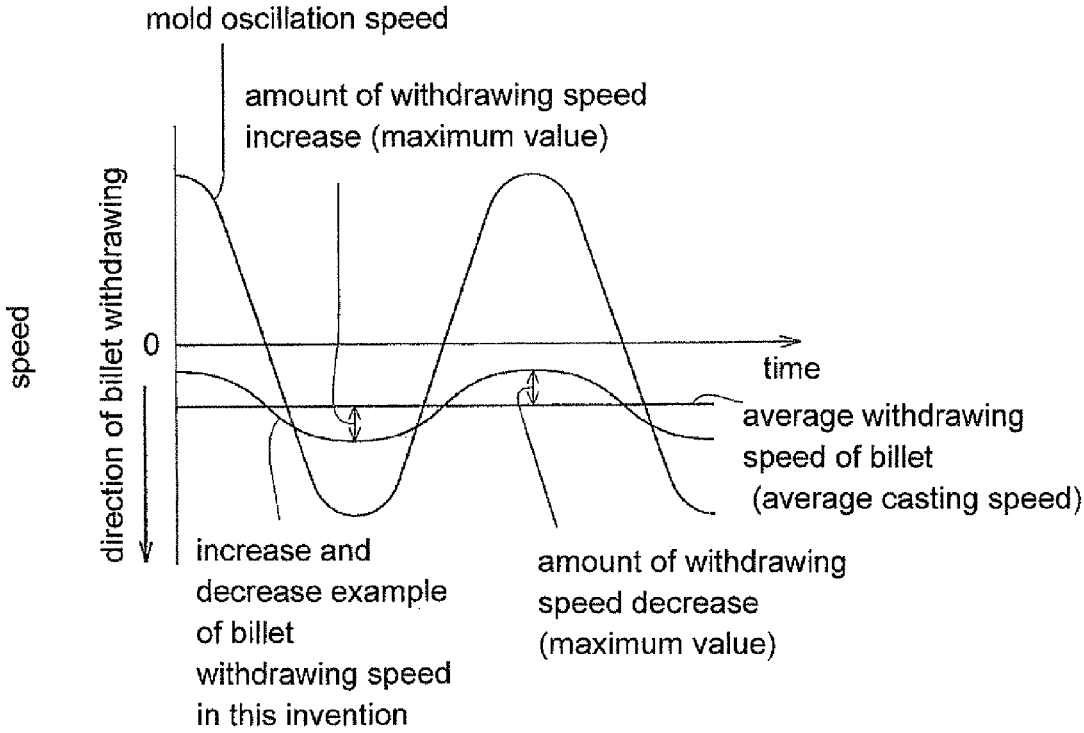
FIG. 3 is a depiction showing an example of the relation between mold oscillation and billet withdrawing speed.

An example of the relation between mold oscillation and billet withdrawing speed is shown in FIG. 3. In this figure, the "average billet withdrawing speed, namely average casting speed" is the above-mentioned "aimed withdrawing speed" determined based on the operational conditions and is a downward speed, as shown in the figure.

Due to the increase or decrease in the "mold oscillation speed" in the above figure in association with the ascending or descending of the mold 4, the friction force between the mold 4 and the billet 6 (more precisely, the solidified shell 5) changes and the friction force in the mold as exerted on the billet 6 increases or decreases. This change of the friction force in the mold is transmitted via the billet 6 to the pinch rolls 7, so that the revolution speed of the pinch rolls is passively reduced or increased. As a result, the actual billet withdrawing speed is lower than the average withdrawing speed during the upward period of mold oscillation and it becomes greater than the average withdrawing speed during the downward period of mold oscillation, as illustrated in the same figure by the curve "example of increase and decrease in billet withdrawing speed in the practice of the invention". In this manner, the friction force between the mold and the billet can be stably reduced.

2. Grounds for Specifying Constitutional Elements and Preferred Modes of Embodiment

2-1. Type of Casting Machine

The present invention is applied to a mode of operation in which the billet cross sectional area is relatively small and the casting speed is relatively high in general continuous casting in which the mold is oscillated upward and downward.

The reason why the continuous casting machine to be used in the practice of the invention is limited to a curved type or vertical type continuous casting machine is that in the case of a vertical bending type continuous casting machine (constituted of vertical straight segment and bent segment), the friction force in the bent section is so large and the movement of the billet in association with mold oscillation is hardly transmitted to the pinch rolls.

2-2. Proper Billet Withdrawing Speed Pattern

By employing a pattern such that the billet withdrawing speed is slower than the average withdrawing speed during the upward period of mold oscillation and the billet withdrawing speed is faster than the average withdrawing speed during the downward period of mold oscillation, it becomes possible to lower the maximum value of the friction force between the mold and the billet. According to the findings obtained by the present inventors, the friction force between the mold and the billet depends on the difference of velocity between the both (relative velocities). Thus, the friction force increases during the upward period of mold oscillation during which the relative velocities of the both increase and, during the downward period of mold oscillation during which the relative velocities of the both decrease, it decreases. Therefore, by reducing the billet withdrawing speed during the upward period of mold oscillation and increasing the billet withdrawing speed during the downward period of mold oscillation, it becomes possible to level the friction force between the mold and the billet and lower the maximum friction force between the mold and the billet.

If attention is paid only to the relative velocities of the mold and the billet, the same effect as mentioned above ought to be obtained by reducing the oscillation amplitude or frequency to lower the oscillation velocity. However, when only the oscillation amplitude or frequency is reduced, the effect intrinsic in oscillation, namely the effect of promoting the consumption of a lubricant, such as a mold powder, between the mold 4 and the billet 6 (more precisely, the solidified shell 5) is reduced and the friction force within the mold is rather increased.

On the contrary, when the method of the invention is employed, the friction force within the mold is stably and surely reduced. This is presumably due to the fact that the feed of a lubricant, such as a mold powder, is promoted owing to the changing billet withdrawing speed.

2-3. Mechanism for Billet Withdrawing Speed Oscillation and Amount of Play

Suitably used as the mechanism for respectively reducing and increasing the billet withdrawing speed during the upward and downward periods of mold oscillation in the practice of the invention is a mechanism comprising motors for driving pinch rolls 7 at a speed corresponding to an aimed withdrawing speed and structural play in the directions of driving and reverse driving as disposed between the pinch rolls 7 for withdrawing or supporting the billet 6. The reason therefor is that such mechanism is simple and can be designed in a compact manner and requires no complicated control operations.

Further, this mechanism is required to have a function such that the reaction force of the elastic parts for returning to the neutral position increases as the amount of a play-incurred displacement from the neutral position of the play increases. This is because such function can suppress unwanted variations in withdrawing speed. The above function can be realized with ease by employing a mechanism comprising elastic parts either alone or in combination with dampers.

It is appropriate that the amount of the play-incurred displacement in the direction of driving or reverse driving from the neutral position of the play be 2-30 mm in the direction of driving and 2-30 mm in the direction of reverse driving, each on the pinch roll circumferential length equivalent basis. When the amount of the play-incurred displacement is less than 2 mm in the direction of driving or in the direction of reverse driving on the pinch roll circumferential length equivalent basis, the effects of the invention are lessened. When the amount of the play-incurred displacement is in excess of 30 mm in the direction of driving or in the direction of reverse driving on the pinch roll circumferential length equivalent basis, the variations in withdrawing speed become unnecessarily large and thereby impair the condition of stable operation.

2-4. Cross Sectional Area and Length of the Target Billet

It is necessary that the cross sectional area of the target billet be not more than 700 $cm^2$ and that the length of the billet 6 from the meniscus 10 in the mold 4 to the site 9 of cutting of the billet 6 be not more than 50 m. When the cross sectional area of the billet 6 is in excess of 700 $cm^2$ or when the length of the billet 6 from the meniscus 10 to the billet cutting site 9 is in excess of 50 m, the mass of the billet 6 from the mold 4 to the pinch rolls 7 becomes great and the friction force within the mold becomes relatively weak as compared with the inertial force of the billet, with the result that the effects of the invention are hardly produced.

2-5. Amount of Secondary Cooling Water and Casting Speed

It is necessary that the specific amount of secondary cooling water be not more than 0.8 L/kg of steel and that the casting speed be not less than 1.5 m/min. The reasons are as follows.

When the specific amount of secondary cooling water is in excess of 0.8 L/kg of steel, or when the casting speed is lower than 1.5 m/min, the average temperature of the billet 6 from the mold 4 to the pinch rolls 7 lowers and the billet 6 becomes solidified. For preventing the billet 6 from becoming solidified, the average temperature of the billet 6 from the mold 4 to the pinch rolls 7 is preferably not less than 1100° C. The average temperature of the billet 6, so referred to herein, indicates the average temperature of the completely solidified shell. The billet in a normal condition of casting elastically expands and contracts in response to the increase or decrease of the friction force within the mold, and this expansion and contraction phenomenon, in association with the oscillation, increases or decreases the withdrawing speed of the solidified shell 5 in the mold 4 and thus serves to reduce the maximum value of the friction force in the mold 4. When, however, the billet becomes solidified, as mentioned above, the elastic expansion and contraction of the billet become less, so that the maximum value of the friction force in the mold tends to increase. Under such conditions, it becomes difficult to suppress the friction force in the mold to a sufficient extent even by incorporating the mechanism for withdrawing speed oscillation to be used in the practice of the invention between the motors and the pinch rolls.

The lower limit to the specific amount of secondary cooling water is not particularly given. In the light of the lower limit value in ordinary continuous casting, however, the range preferably includes about 0.1 L/kg of steel and higher levels. The upper limit to the casting speed is not particularly specified, either. In view of the upper limit value in ordinary continuous casting, however, the range preferably includes about 5.0 m/min and lower levels.

2-6. Amplitude and Frequency of Mold Oscillation

It is necessary that the amplitude of oscillation be ±1.5 to ±4.0 mm. When the amplitude of oscillation is less than ±1.5 mm, the effect intrinsic in oscillation, namely the effect of promoting the consumption of a lubricant, such as a mold powder, between the mold and the billet is reduced and the friction force within the mold is rather increased, so that even when the method of the invention is applied, it is difficult to suppress the friction force in the mold to a sufficient extent. On the other hand, when the oscillation amplitude is in excess of ±4.0 mm, the movement of the billet, which is in association with the oscillation, becomes excessive and the withdrawing speed tends to vary unnecessarily.

It is necessary that the frequency of mold oscillation be not more than 450 cpm (cycles/minute). This is because when the oscillation frequency is in excess of 450 cpm, it becomes difficult to cause the movement of the billet to follow the oscillation. The lower limit to the oscillation frequency is not particularly specified. In view of the casting speed range specified herein and a general lower limit to the range of oscillation frequency, however, the range of frequency preferably includes about 100 cpm and higher levels.

Examples

For confirming the effects of the continuous casting method of the invention, the following casting tests were carried out and the results were evaluated. The test conditions and test results are shown in Table 1.

TABLE 1

| | Test No. | | | |
|---|---|---|---|---|
| | A | B | C | D |
| Classification | Inventive example | Comparative example | Inventive example | Comparative example |
| Type of continuous casting machine | Curved | Curved | Vertical | Vertical |
| Average withdrawing speed (m/min) | 3.0 | 3.0 | 1.8 | 1.8 |
| Amount of increasing and decreasing of withdrawing speed in upward/downward period of mold oscillation | ±0.7 | Less than ±0.1 | ±0.4 | Less than ±0.1 |
| Mechanism for withdrawing speed oscillation | Elastic torsion coupling with built-in coil spring | None | Elastic torsion coupling with built-in disk-shaped rubber plate | None |
| Structural play in driving direction in mechanism for withdrawing speed oscillation (pinch roll circumferential length equivalent basis, mm) | ±15 | — | ±5 | — |
| Nominal mold size (mm) | 190ϕ | 190ϕ | 100 × 600 | 100 × 600 |
| Billet cross sectional area ($cm^2$) | 280 | 280 | 600 | 600 |
| Billet length from meniscus to billet cutting device (m) | 40 | 40 | 4 | 4 |
| Specific amount of secondary cooling water (L/kg-steel) | 0.4 | 0.4 | 0.6 | 0.6 |
| Amplitude of oscillation (mm) | ±2.3 | ±2.3 | ±3.0 | ±3.0 |
| Frequency of oscillation (cpm) | 250 | 250 | 180 | 180 |
| Composition of steel cast (% by mass) | 1.0% C—0.2% Si—0.6% Mn—1.0% Cr—0.5% Mo—0.01% Al | | 0.05% C—0.1% Si—0.4% Mn—0.05% Al | |
| Maximum friction force between billet and mold* | 70 | 100 (reference) | 85 | 100 (reference) |

(Note):

*indicates that the value given is a relative value with the value obtained without incorporation of the mechanism for withdrawing speed oscillation of the invention being taken as 100.

Tests Nos. A and C are tests for typical inventive examples satisfying the conditions specified herein and Tests Nos. B and D are tests for comparative examples failing to satisfy the conditions specified herein. In each of the Tests Nos. A, B, C and D, the average temperature of the billet 6 from the mold 4 to the pinch rolls 7 was not less than 1100° C.

Test No. A is a test in which the casting method of the invention was performed using a curved type continuous round billet casting machine. In Test No. A, an elastic torsion coupling with a built-in coil spring was incorporated in the output spindle of each pinch roll driving motor and the casting test was carried out otherwise under the same test conditions as those in Test No. B, which was a comparative test. Owing to the effect of the above-mentioned elastic torsion coupling, the mechanism for withdrawing speed oscillation used in Test No. A showed a play-incurred displacement of ±15 mm in the direction of driving on the pinch roll circumferential length equivalent basis. The test in Test No. A simultaneously satisfied all the other requirements specified herein as well.

As a result, in Test No. A, the effect of reducing the friction force between the mold and the billet was produced satisfactorily and a better result was obtained, namely the maximum friction force between the mold and the billet was lowered by 30% as compared with Test No. B, which was a comparative example.

In Test No. C, the casting method of the invention was tested using a vertical type pilot continuous casting machine. In Test No. C, an elastic torsion coupling transmitting the driving force via a disk-shaped rubber plate was incorporated in the reduction gear side end portion of each pinch roll driving shaft and the casting test was carried out otherwise under the same test conditions as in Test No. D, which was a comparative example. This elastic torsion coupling had a mechanical stopper restricting the amount of the play-incurred displacement. Owing to the effect of the above-mentioned elastic torsion coupling, the mechanism for withdrawing speed oscillation used in Test No. C showed play-incurred displacement of ±5 mm in the direction of driving on the pinch roll circumferential length equivalent basis. The test in Test No. C simultaneously satisfied all the other requirements specified herein as well.

As a result, in Test No. C, too, the effect of reducing the friction force between the mold and the billet was produced and the maximum friction force between the mold and the billet could be reduced by 15% as compared with Test No. D, which was a comparative example.

INDUSTRIAL APPLICABILITY

By providing a mechanism for withdrawing speed oscillation having structural play within a specified range in the direction of driving and in the direction of reverse driving between each motor for driving pinch rolls and the pinch rolls and at the same time optimizing the billet cross sectional area, the billet length from the meniscus to the site of billet cutting, the specific amount of secondary cooling water for the billet, the casting speed, the oscillation amplitude and the oscillation frequency in a continuous casting method involving upward and downward oscillation of the mold in accordance with the method of the invention, it becomes possible to render the billet withdrawing speed during the upward period of mold oscillation slower than the average withdrawing speed and the billet withdrawing speed during the downward period of mold oscillation faster than the average withdrawing speed and thereby stably reduce the friction force between the mold and the billet.

Therefore, the method of the invention can be widely applied in the field of casting as a continuous casting method which can produce high-quality billets under stable operational conditions while preventing the billet from sticking to the mold as a result of providing a simple mechanism for withdrawing speed oscillation.

What is claimed is:

1. A method of continuously casting a billet with a small cross section in which the billet has a cross sectional area of not more than 700 $cm^2$ and a curved type or vertical type continuous casting machine is used while oscillating the mold upward and downward, wherein:

the casting machine is provided with a mechanism for withdrawing speed oscillation, wherein the mechanism comprises elastic parts either alone or in combination with dampers between motors for driving pinch rolls at a speed corresponding to an aimed withdrawing speed and the pinch rolls, the mechanism has structural play in the directions of driving and reverse driving in such a manner that the amount of a play-incurred displacement from the neutral position of the structural play in the direction of driving the billet or reverse driving is 2-30 mm in the direction of driving and 2-30 mm in the direction of reverse driving, each on the pinch roll circumferential length equivalent basis, and mechanism further has a function such that the reaction force of the elastic parts for returning to the neutral position increases in response to the increase in the play-incurred displacement from the neutral position;

the drive of each motor is transmitted to the pinch rolls via the mechanism for withdrawing speed oscillation, whereby: the billet withdrawing speed during the upward period of mold oscillation becomes slower than an average withdrawing speed and faster during the downward period of mold oscillation than the average withdrawing speed;

and operational parameters are set such that a length of the billet from the meniscus to the site of cutting of the billet is not more than 50 m, a specific amount of secondary cooling water is not more than 0.8 liter/kg of steel, a casting speed is not less than 1.5 m/min, an amplitude of oscillation is ±1.5 to ±4.0 mm, and a frequency of oscillation is not more than 450 cpm.

* * * * *